US010782094B2

(12) United States Patent
Rogers et al.

(10) Patent No.: US 10,782,094 B2
(45) Date of Patent: Sep. 22, 2020

(54) HOLSTER MOUNT WITH ADJUSTABLE DROP AND CANT

(71) Applicant: Safariland, LLC, Jacksonville, FL (US)

(72) Inventors: William H. Rogers, St. Augustine, FL (US); Matthew E. McKendrick, Jacksonville, FL (US); Dylan Vaccaro, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 54 days.

(21) Appl. No.: 15/950,731

(22) Filed: Apr. 11, 2018

(65) Prior Publication Data

US 2019/0219359 A1 Jul. 18, 2019

Related U.S. Application Data

(63) Continuation-in-part of application No. 15/874,401, filed on Jan. 18, 2018.

(51) Int. Cl.
*F41C 33/04* (2006.01)
*A45F 5/02* (2006.01)

(52) U.S. Cl.
CPC ..... *F41C 33/045* (2013.01); *A45F 5/021* (2013.01); *A45F 2005/025* (2013.01); *A45F 2005/027* (2013.01); *A45F 2200/0591* (2013.01)

(58) Field of Classification Search
CPC ..... Y10S 224/911; Y10S 224/912; A45F 2005/025; A45F 2005/026;
(Continued)

(56) References Cited

U.S. PATENT DOCUMENTS 3,315,855 A * 4/1967 Boone ..... A45F 5/02 224/255
5,167,355 A 12/1992 Hill
(Continued)

FOREIGN PATENT DOCUMENTS

AU 649945 B3 6/1994
DE 3027550 A1 3/1982
(Continued)

OTHER PUBLICATIONS

European Patent Application No. 18155876.8—Extended European Search Report dated Aug. 6, 2018.
(Continued)

*Primary Examiner* — Nathan J Newhouse
*Assistant Examiner* — Matthew T Theis
(74) *Attorney, Agent, or Firm* — Kane Kessler, P.C.; Paul E. Szabo

(57) ABSTRACT

A holster support assembly for use by a user wearing a belt may be adjustable for both drop and cant. The assembly includes a belt support that engages and is supported by the user's belt, the belt support defining a plurality of drop positions spaced apart along the track to enable the user to set the drop position of the holster. The assembly also includes a holster mount supported on the belt support for sliding movement relative to the belt support, the holster mount configured for supporting a holster. The holster mount has a first condition in which the holster mount is engaged with the belt support thereby blocking rotation of the holster mount relative to the belt support, and is selectively movable into a second condition in which the holster mount is rotatable relative to the belt support about an axis to enable the user to set the cant position of the holster relative to the belt support. The assembly may include a pull member for helping the user to move the holster mount
(Continued)

relative to the belt support, and blocking insert for blocking movement of the holster support into the second condition.

15 Claims, 17 Drawing Sheets

(58) Field of Classification Search
CPC ..... A45F 2005/027; A45F 5/00; A45F 5/02; A45F 5/021; A45F 2200/0591; F41C 33/0245; F41C 33/0263; F41C 33/02; F41C 33/041; F41C 33/043; F41C 33/045; F41C 33/0209
USPC ..... 224/198
See application file for complete search history.

(56) References Cited

U.S. PATENT DOCUMENTS 5,372,288 A * 12/1994 Rogers ..... A45F 5/00 224/198
5,419,472 A * 5/1995 Hellweg ..... A45F 5/02 224/193
5,875,944 A * 3/1999 Beletsky ..... A45F 5/02 224/198
6,575,343 B2 6/2003 Mossman
6,685,067 B2 2/2004 French
7,866,515 B1 1/2011 Buis, III
8,544,706 B2 * 10/2013 Crye ..... F41C 33/045 224/193
9,109,857 B2 8/2015 Kendrick
2004/0251284 A1 * 12/2004 Pelligrini ..... A45F 5/02 224/198
2012/0192461 A1 * 8/2012 Backus ..... F16B 5/0657 36/136
2013/0181018 A1 7/2013 Kendrick
2015/0097011 A1 4/2015 Clifton, Jr.

FOREIGN PATENT DOCUMENTS

EP 1479998 11/2004
JP H0588318 12/1993
JP H09 229596 A 9/1997
WO 2011141453 A1 11/2011

OTHER PUBLICATIONS

Height Adjustable Holster.
European Patent Application No. 19151040.3—Extended European Search Report dated Jun. 27, 2019.

* cited by examiner

HOLSTER MOUNT WITH ADJUSTABLE DROP AND CANT

RELATED APPLICATIONS

This application is a continuation-in-part of U.S. patent application Ser. No. 15/874,401, filed Jan. 18, 2018, of the same inventors, the entire disclosure of wich is incorporated by reference.

BACKGROUND OF THE INVENTION

This invention relates to an apparatus for adjustably supporting a holster on a user's belt. In particular, the invention relates to an apparatus that enables a user to place the holster in a first position of drop and/or cant relative to the user while seated in a car or other vehicle, and then place the holster in a second, different position of drop and/or cant relative to the user after exiting the vehicle.

When a user carries a handgun in a holster on the user's belt, and is standing up, the handgun needs to be in a position to enable rapid and accurate drawing of the handgun from the holster. The holster mounts the handgun at a height near the waist or hip of the user and, in some adjustable holsters, in a selected position of cant But when the holster is in this "use" position, and the user thereafter sits down in a vehicle, the holster and gun are awkwardly positioned.

SUMMARY OF THE INVENTION

A holster support assembly for use by a user wearing a belt may in some embodiments be adjustable for both drop and cant in a second one of such embodiments, a pull stick is provided for ease of adjustment. In another embodiment, the holster support assembly, though using the same parts as the first embodiment, is adjustable only for drop.

DETAILED DESCRIPTION

Figure 1:
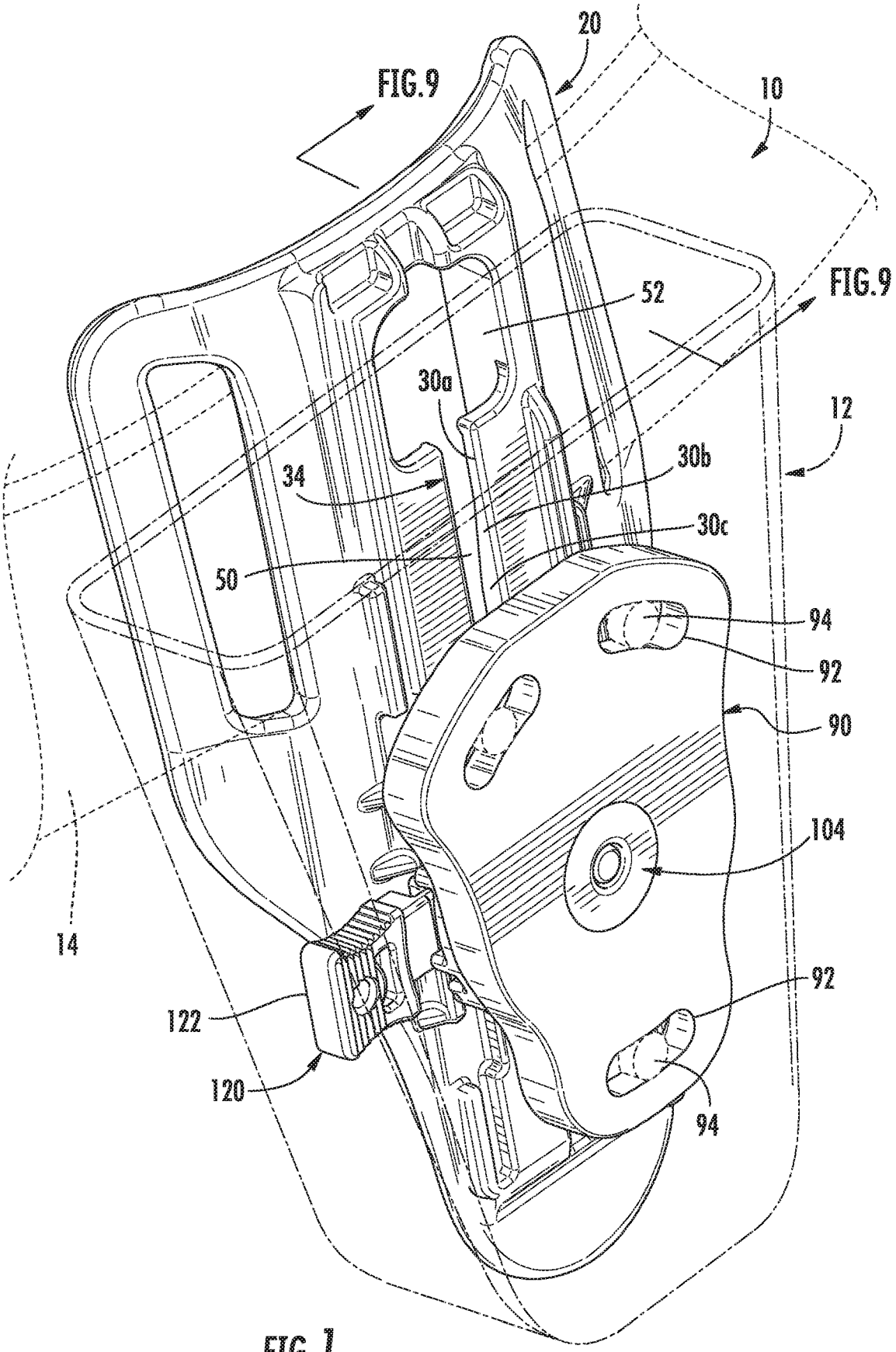
FIG. 1 is a perspective view of a holster assembly that is a first embodiment of the invention, taken from the outside and shown supporting a holster on a user's belt.
Figure 2:
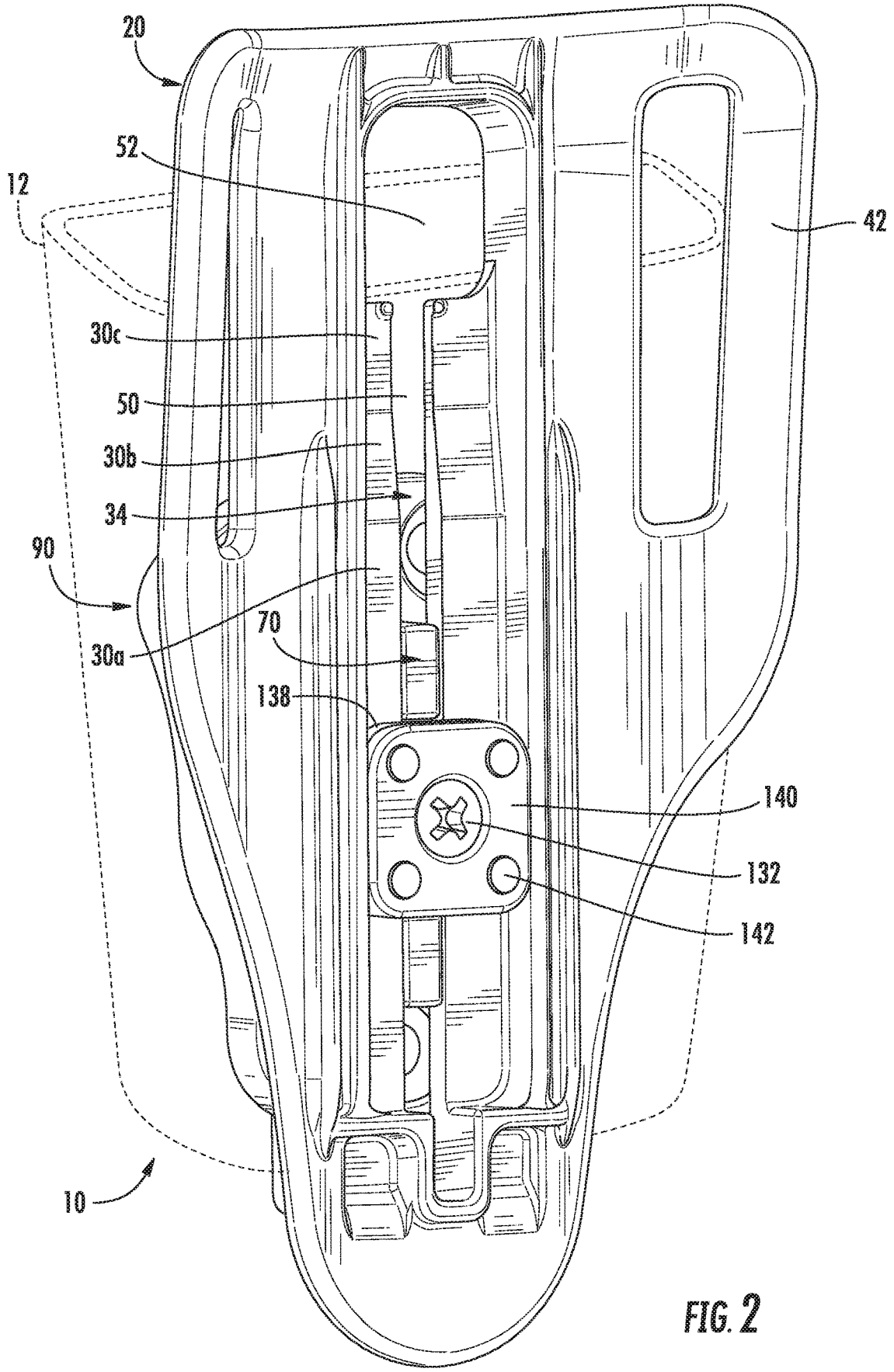
FIG. 2 is a perspective view of the holster assembly of FIG. 1, takes from the inside.
Figure 3:
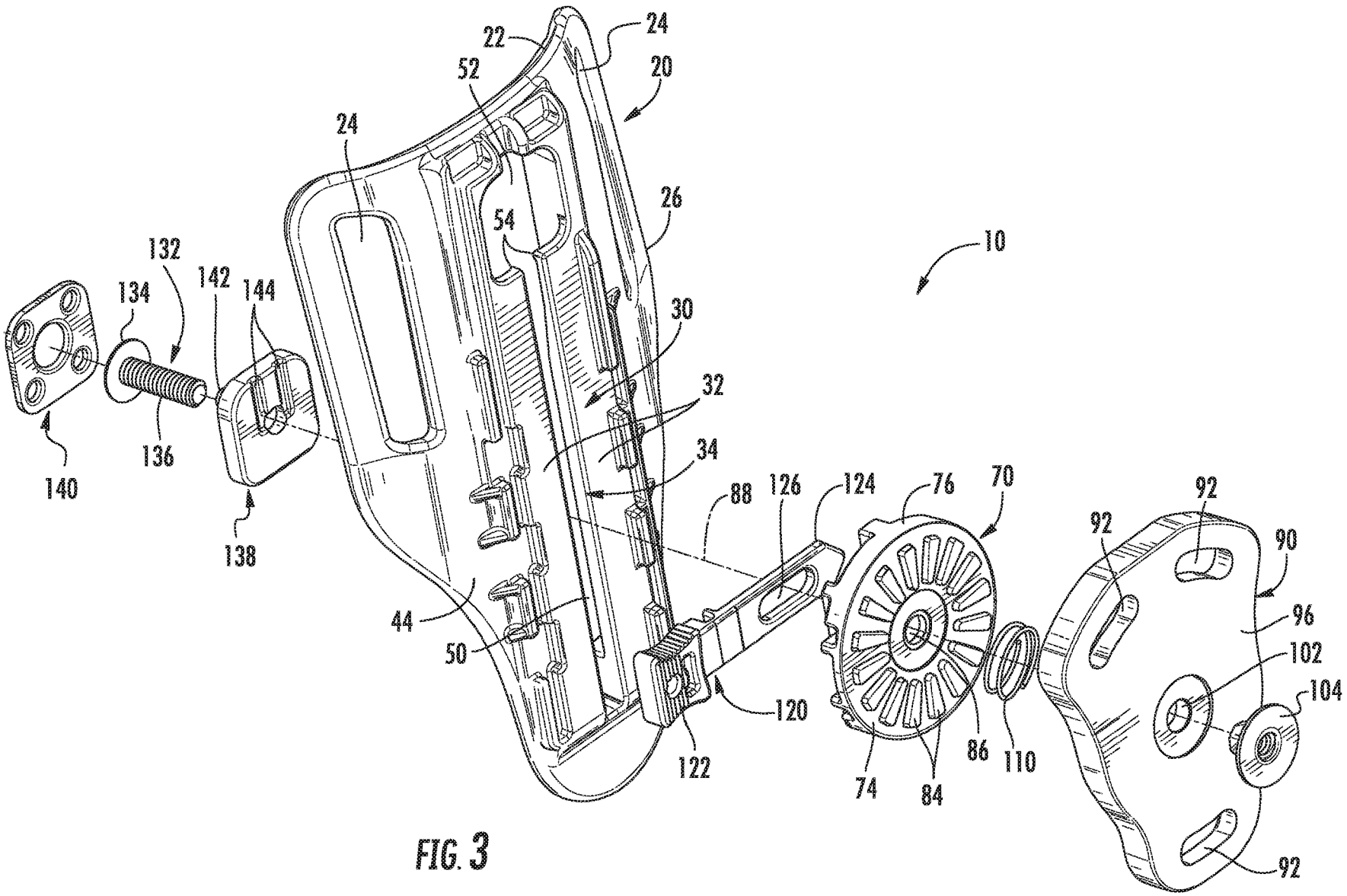
FIG. 3 is an exploded perspective view of the holster assembly of FIG. 1.
Figure 4:
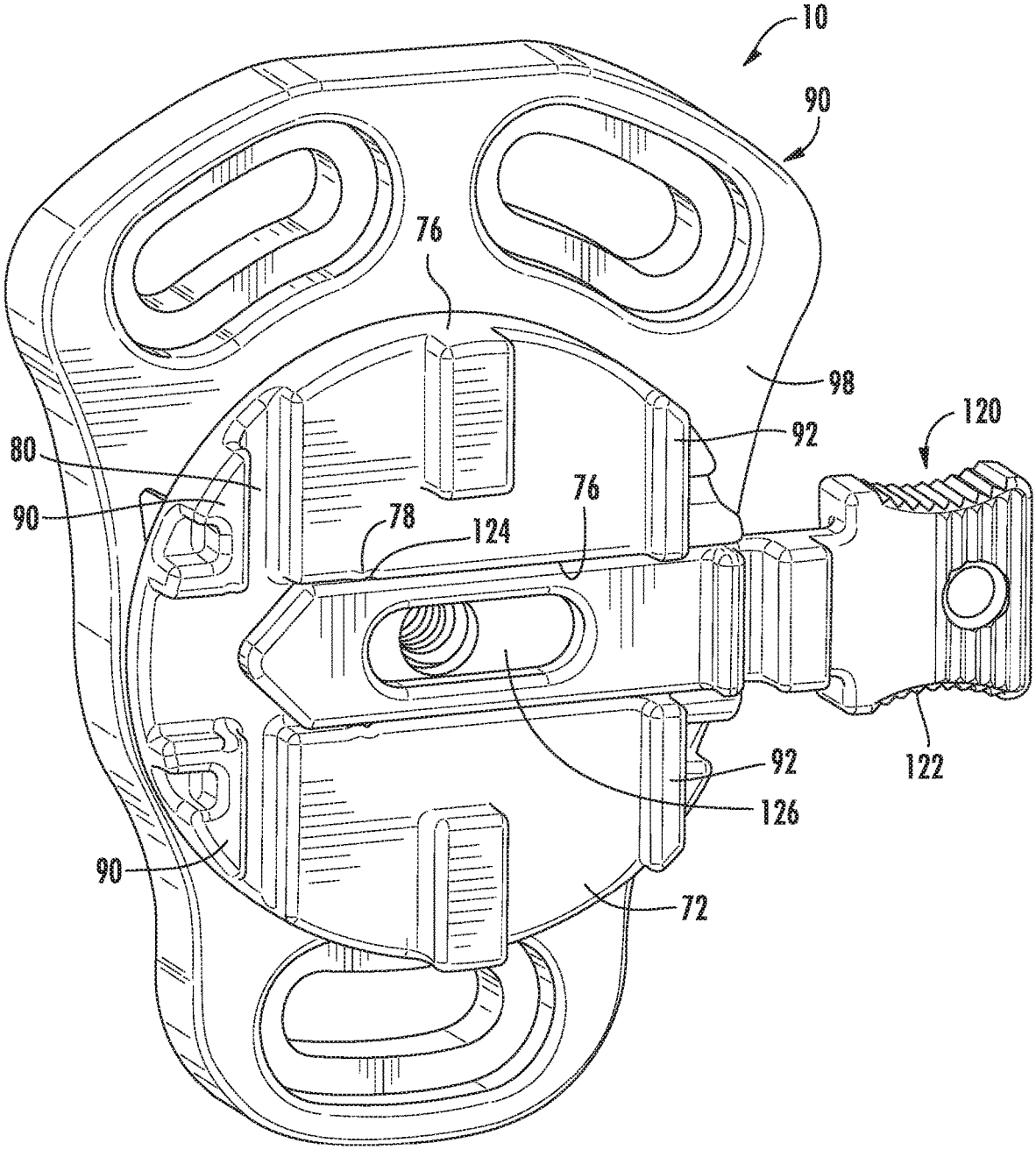
FIG. 4 is a perspective view of part of the holster assembly of FIG. 1 including a holster mount, a slider, and a lock bar.
Figure 5:
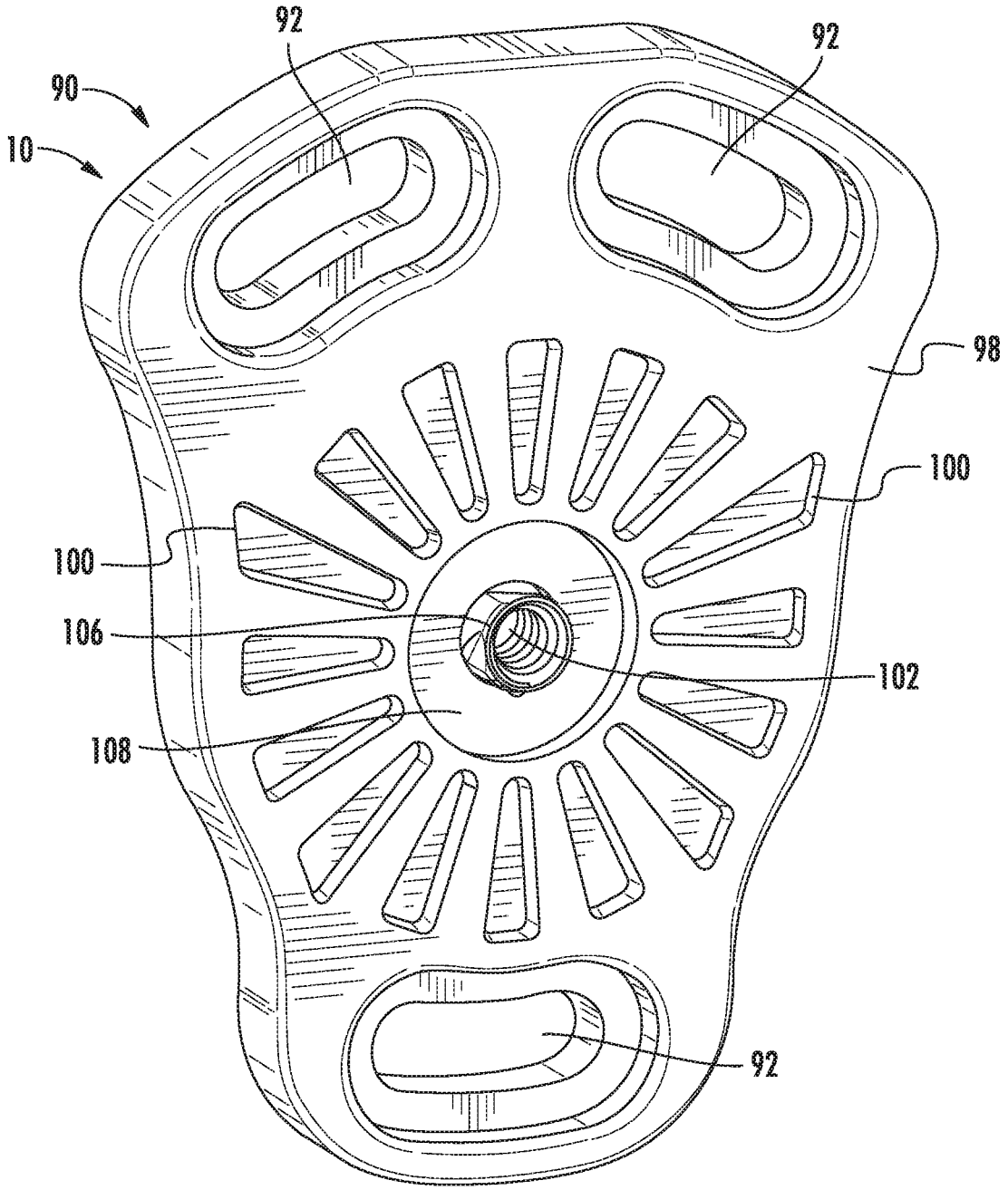
FIG. 5 is a view of the holster r mount of FIG. 4 from the opposite side.
Figure 6:
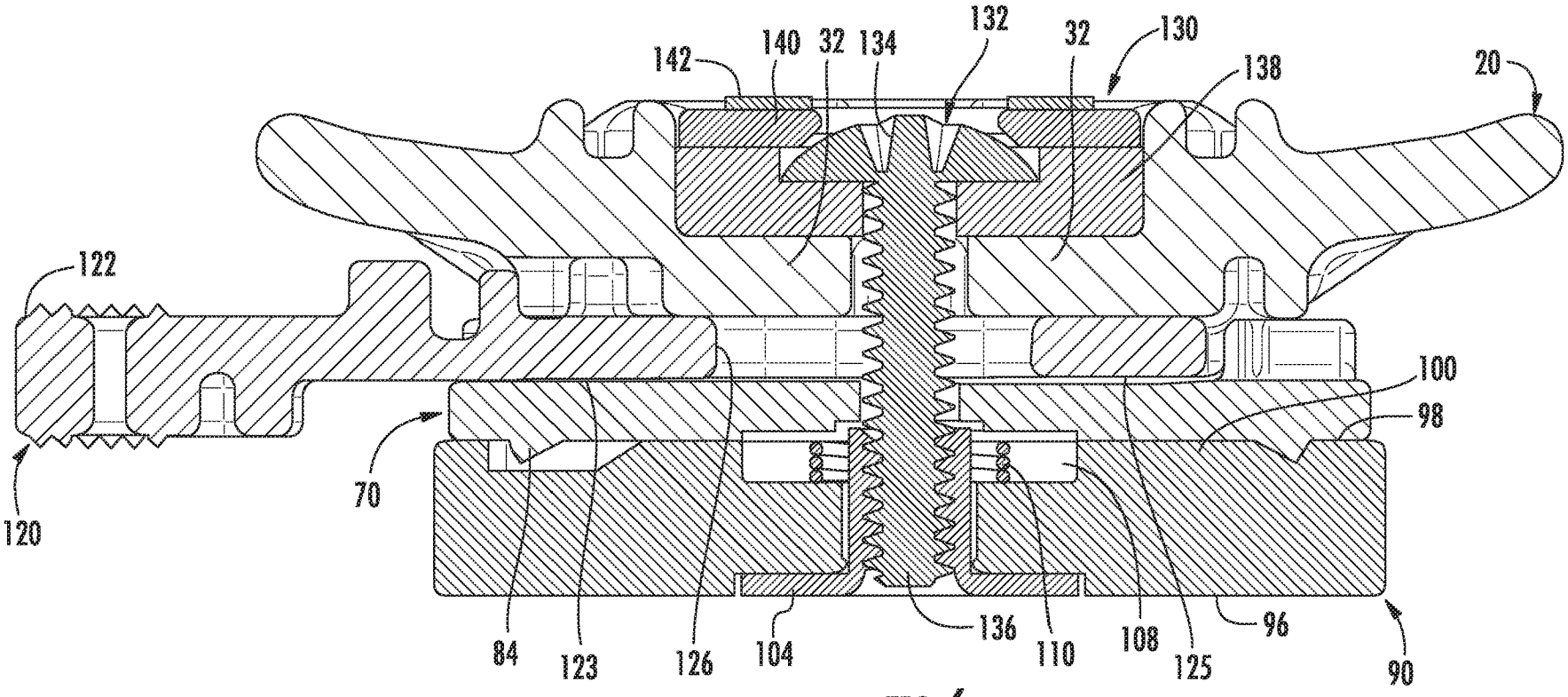
FIG. 6 is a transverse sectional view through the holster assembly of FIG. 1.

The present invention relates to a holster support assembly for adjustably supporting a holster on a user. The invention is applicable to holster mount assemblies of various configurations. As representative of the invention, FIGS. 1-10 illustrate a holster support assembly that is a first embodiment of the invention. The holster support assembly 10 is usable for supporting a holster, shown schematically at 12, n user's belt shown partially at 14.

The holster support assembly 10 includes generally five components, each described below in detail: a belt support 20 that is carried on the user's belt; a slider 70 that is slidable vertically on the belt support; a holster mount 90 that is connected with the slider (to adjust drop) and also is pivotable relative to the slider (to adjust cant); a lock bar 120 for locking the parts in a selected vertical (drop) and rotational (cant) position; and a screw assembly 130 for securing together the other components of the holster support assembly 10.

The belt support 20 (FIGS. 1-3 and 7) supports the assembly 10 on the user's belt 14. The belt support 20 has an upper end portion 22 that is curved or contoured to fit the curved configuration of the user's torso. The upper end portion 22 includes two belt slots 24 for receiving the user's belt 14. The belt support 20 can thus be hung from the user's belt 14, and slid (positioned) laterally along the belt, so that the holster assembly 10 is in the desired position adjacent to the user's hip.

A main body portion 26 of the belt support 20 extends down from the upper end portion 22. A laterally central section of the main body portion 26 forms a vertically extending track 30, which comprises two rails 32 on opposite sides of a central slot 34. The rails 32*a* and 32*b* have a generally planar, plate-like configuration. As described below in detail, the slider 70 and holster body are movable vertically along the track 30 to adjust the drop of the holster 12.

The central slot 34, which is also part of the track 30, extends completely through the belt support 20 between the inner and outer side surfaces 42 and 44, respectively, of the belt support. The central slot 34 is defined by the two rails 32 that are on opposite sides of the central slot. For each rail 32 its outer side surface is part of the outer side surface 44 of the belt support 20, and its inner side surface is part of the inner side surface 42 of the belt support.

The central slot 34 has a relatively narrow lower section 50 that is a constant width along its entire length. The central slot 34 has an upper section 52 that is significantly wider than the lower section 50 and that has a generally square configuration. As a result, the slot 34 has a generally keyhole-shaped configuration. At the top of the lower section 50 of the central slot 34, just at the bottom edge of the upper section 52, are located two bump stops 54, one on each rail 32.

The wall thickness of the track rails 32 (from inside to outside, or left to right as viewed in FIGS. 9A-9B) is different, over three different sections of the track 30. Specifically, in a locking section 30*a* of the track 30, starting at the bottom end of the central slot 34, the rails 32 have a constant, first wall thickness. At the top of the locking section 30*a* of the track 30, the wall thickness of the rails 32 decreases to form a ramp section 30*b* of the track that has a tapering second wall thickness. Above the ramp section 30*b*, in a release section 30*c* of the track 30, and adjacent to the enlarged upper section 52 of the central slot 34, the rails 32 have a constant reduced third wall thickness that is the same as the thinnest part of the ramp section.

Because the central slot 34 is located between and defined by the rails 32, the depth of the slot varies in the same manner as does the wall thickness of the rails. Specifically, the slot 34 is deeper in the locking section 30*a* of the rails 32, tapers in depth in the ramp section 30*b*, and is shallowest in the release section 30*c*.

As described below in detail, the slider 70 is slidable vertically along the track 30 of the belt support 20. In that regard, the belt support 20 has a number of features for helping to set the vertical orientation of the slider 50 on the belt support. Specifically, on one side of the track 30 are formed three notches 56. On the opposite side of the track 30 are four rib segments 58 spaced apart with gaps 60 between them. The notches 56 and the gaps 60 are located along the lower portion (constant wall thickness) 30*a* of the track 30. The notches 56 are located laterally opposite and thus paired with the gaps 60.

Each associated pair of notch 56 and gap 60 defines a detent (or locking position) 62 on the belt support. In the illustrated embodiment, there are three vertically spaced locking positions 62*a*, 62*b*, 62*c*. In other embodiments, an assembly 10 in accordance with the invention could have more than three locking positions 62 or fewer than three locking positions.

The slider 70 (FIGS. 3-4) engages with the belt support 20 and supports the holster mount 90 for vertical and rotational (pivotal) movement relative to the belt support. The slider 70 is a disc-shaped member having generally planar inner and outer major side surfaces 72 and 74 connected by an annular outer peripheral surface 76.

The inner major side surface 72 of the slider 70 is engageable with and slidable along the outer major side surface 44 of the belt support 20. Several features are present on the inner major side surface 72 of the slider 70. First, there is a horizontally extending groove 76 having dimensions selected to closely receive the lock bar 120 in a manner as described below. The groove 76 extends horizontally for the full width of the slider 70. Two detent notches 78 are formed at one position along the length of the groove 76.

Second, there is a vertical groove 80 at one side of the slider 70. When the slider 70 is mounted on the belt support 20, the groove slidably 80 receives the ribs 58 of the belt support. This engagement of the ribs 58 in the groove 80 secures the slider 70 against rotation about the transverse axis 88. Third, two generally triangular restraint tabs 89 are disposed along the length of the vertical groove 80, on opposite sides of the groove. The restraint tabs 89, as well as two shorter ribs 92 diametrically opposite the groove 80, assist in maintaining the positioning of the slider 70 on the belt support 20.

On the outer major side surface 74 of the slider 70, facing away from the belt support 20, there is formed a circular array of wedge-shaped locking teeth 84. The teeth 84 extend radially outward from a centrally located through hole 86 that defines a transverse axis 88 of the holster assembly 10.

The holster mount 90 is a member that is configured to directly engage and support the holster 12 itself on the slider. As a result, and as described in detail below, the holster 12, the holster mount 90, and the slider 70 are movable vertically, together, along the track 30 of the belt support 20.

The holster mount 90 is a plate-like member that in the illustrated embodiment has a generally teardrop-shaped configuration including a wider upper end portion and a narrower lower end portion to accommodate the similar configuration of a typical holster. Two holster connection openings 92 are located in the upper end portion of the holster mount 90 and one holster connection opening 92 is provided in the lower end portion of the holster mount. The holster connection openings 92 receive fasteners shown schematically at 94 (FIG. 1) for securing the holster 12 to the holster mount 90. The openings 92 may, as illustrated, be arcuate slots enabling mounting of the holster 12 at different pivotal (rotational) orientations on the holster mount 90.

The holster mount 90 has a generally flat outer major side surface 96 that is presented outward and that is in abutting engagement with the holster 12 when the holster is secured on the holster mount. The holster mount 90 has an opposite inner major side surface 98 that is presented inward toward the user, and toward the slider 70, when the holster mount is connected as part of the holster assembly 10. On the inner major side surface of the holster mount 90 is a circular array of radially extending, wedge-shaped locking teeth 100, effectively a mirror image of the array of locking teeth 84 on the slider 70.

The holster mount 90 has a central opening 102 that is co-axial with the central opening 86 in the slider 70 when the holster assembly 10 is assembled. An internally threaded propeller nut or T-rout 104 is secured in the central opening 102 of the holster mount 90, on the outside of the holster mount, to provide an internally threaded location for receiving the assembly screw 132.

An annular boss 106 extends around the opening 102, on the inner side surface 98 of the holster mount 90. An annular spring chamber 108 extends around the boss 106. The spring chamber 108 receives a circular compression spring 110. The spring 110 acts outwardly between the slider 70 and the holster mount 90, attempting to push them apart.

The holster 12 is secured to the holster mount 90 in a known manner, such as by the fasteners 94. In this application, the actual configuration of the holster itself is not critical, and so the holster 12 is shown only in phantom.

The lock bar 120 is configured as an elongate bar that extends laterally across the track 30 of the belt support 20, at a location captured (inside to outside) between the belt support and the slider 70. The lock bar 120 is slidable laterally when in its position between the belt support 20 and the slider 70. At one end of the of the lock bar 120 is manually engageable tab or handle 122 that can be used to pull or push the lock bar across the track 30. The lock bar 120 also has projections 124 that are engageable with the detent notches 78 on the slider 70. An elongate screw passage 126 extends in a direction along the length of the lock bar 120.

The screw assembly 130 includes a screw 132 that in the illustrated embodiment is a machine screw having a round head 134 and an externally threaded shank 136. The screw 132 is assembled with a plastic washer 138 that is fitted under and around the screw head 134. A plate 140 is secured onto the washer 138 by peening over four pins 142 on the washer.

The washer 138 is slightly smaller then the opening of the release section 52 of the central slot 34, so as to be able to fit through the release section. The washer 138 is free floating on the screw 132, that is, the washer and the screw are relatively rotatable.

The washer 138 has a generally square configuration with rounded corners. One of the four corners of the washer may be different from the other three, for assembly and orientation purposes. Also, the underside of the washer 138 (FIG. 3) has two slots 144 that extend halfway up the washer. When the screw assembly 130 is connected in the holster assembly 10, the slots 144 extend from the screw shank 136 in a direction toward the lower section 50 of the central slot 34 in the belt support 20.

To assemble the parts of the holster assembly, the slider 70 is placed on and engaged with the outer side surface 44 of the belt support 20. The vertical ribs 58 on the belt support 20 are received in the vertical groove 80 on the slider 70, this engagement blocks rotation of the slider on the belt support. The tabs 89 on the slider 70 also assist in this regard. As a result, the slider 70 is supported on the belt support 20 for vertical sliding movement along the belt support, without rotation.

At the same time, the lock bar 120 is placed to extend late oily along the horizontal groove 76 in the slider 70, at a position captured between the slider and the belt support 20. The screw slot passage 126 in the lock bar 120 overlies the central opening 86 in the slider 70, and also overlies the central slot 34 in the belt support 20.

The holster mount 90 is positioned on the slider 70, with the compression spring 110 between them in the spring chamber 108 that extends around the boss 106.

The screw assembly 130 holds the other pieces together. Specifically, the screw head 134 and the washer 138 are positioned on the inner side surface 42 of the belt support 20. The screw shank 136 extends through the central slot 34 in the belt support 20, through the central opening 86 in the slider 70, through the screw passage 126 in the lock bar 120, and into the center of the boss 106 on the holster mount 90. The nut 104 is lockingly engaged in the central opening 102 of the holster mount 90, and receives the threaded screw shank 136.

As a result, the parts of the holster assembly 10 are held together securely in the direction along the length of the screw 132. The spring 110 acts outwardly between the slider 70 and the holster mount 90, attempting to push them apart in a direction along the transverse axis 88, that is, along the length of the screw 132.

When the parts are assembled in this manner, it is done with the screw 132 extending through the lower section 50 of the central slot 34 in the belt support 20. In this position, the rails 32 have a relatively large wall thickness and the central slot 34 is relatively deep. The screw 132 is tightened down on the holster mount 90 to a point at which there is little or no movement possible between the parts in a direction along the length of the screw 132, the screw 130 and the nut 104 cooperate to hold the holster mount 90 in tight against the slider 70.

The screw 132 is intentionally not tightened down enough to prevent all vertical movement of the parts along the track 30. Rather, the parts can be moved vertically with the application of a reasonable amount of force, to enable the user to adjust the holster assembly 10. This is because the lock bar 120 (FIG. 6) is thinner at its inner end 125 than at its outer end 123, so that when the lock bar is opened, the parts can be moved easily. The radial teeth 34 of the slider 70 are engaged with the radial teeth 100 of the holster mount 90, preventing any rotation of the holster mount and the holster 12 on the belt support 20.

As a group, the three elements or pieces that slide along the track 30 of the belt mount 20, together as one unit, to effect change in drop height and to allow for adjustment of cant, can be considered to be a "sliding assembly". These three elements are the holster mount 90, the slider 70, and the lock bar 120. The sliding assembly can be positioned farther down the track 30 to place the holster mount 90 in one of the available locking positions. When the sliding assembly and thus the slider 70 are positioned farther upward in the release section of the track 30 the slider and the holster mount 90 can be rotated, to allow for change of cant position.

As noted above, the holster assembly 10 of the present invention is useful for adjustably supporting the holster 12 on the user's belt 14. In a manner as described below, the user can place the holster 12 in a first position of drop and cant relative to the user while seated in a car or other vehicle, and then place the holster in a second, different position of drop and cant after exiting the vehicle.

The three locking positions 62 noted above with reference to the belt support 20, provide three different drop heights for the holster 12 on the belt support. The holster assembly 10 may come from the manufacturer set in one of the three locking positions 62. The user can select and lock in any one of the three available drop heights for use when the user is standing up and wearing the holster assembly 10. The cant position (orientation), however, can be changed only when the holster assembly 10 is unlocked, as described below.

Figure 7:
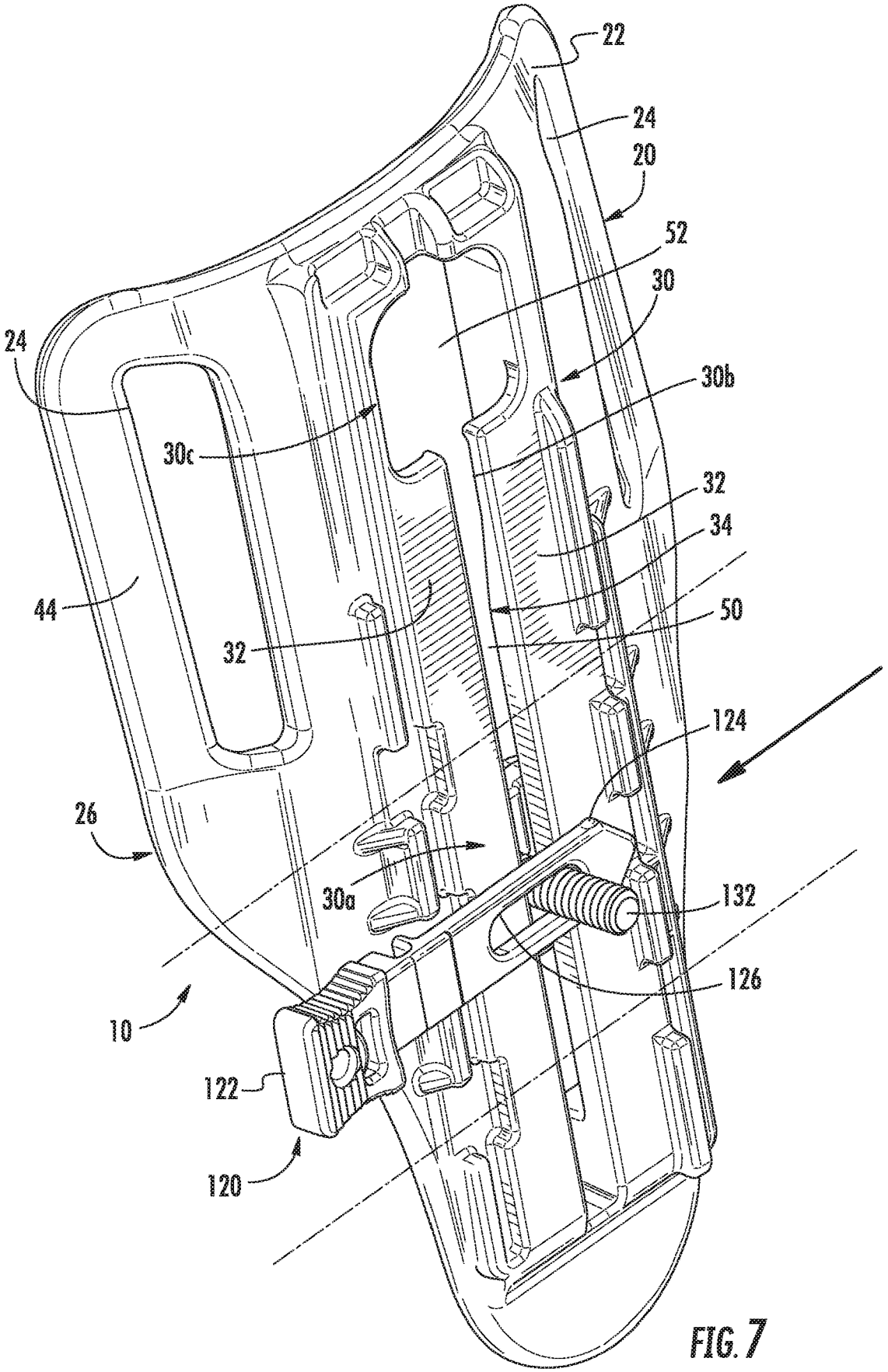
FIG. 7 is a perspective view illustrating the belt support with the look bar in an open or unlocked position.
Figure 8:
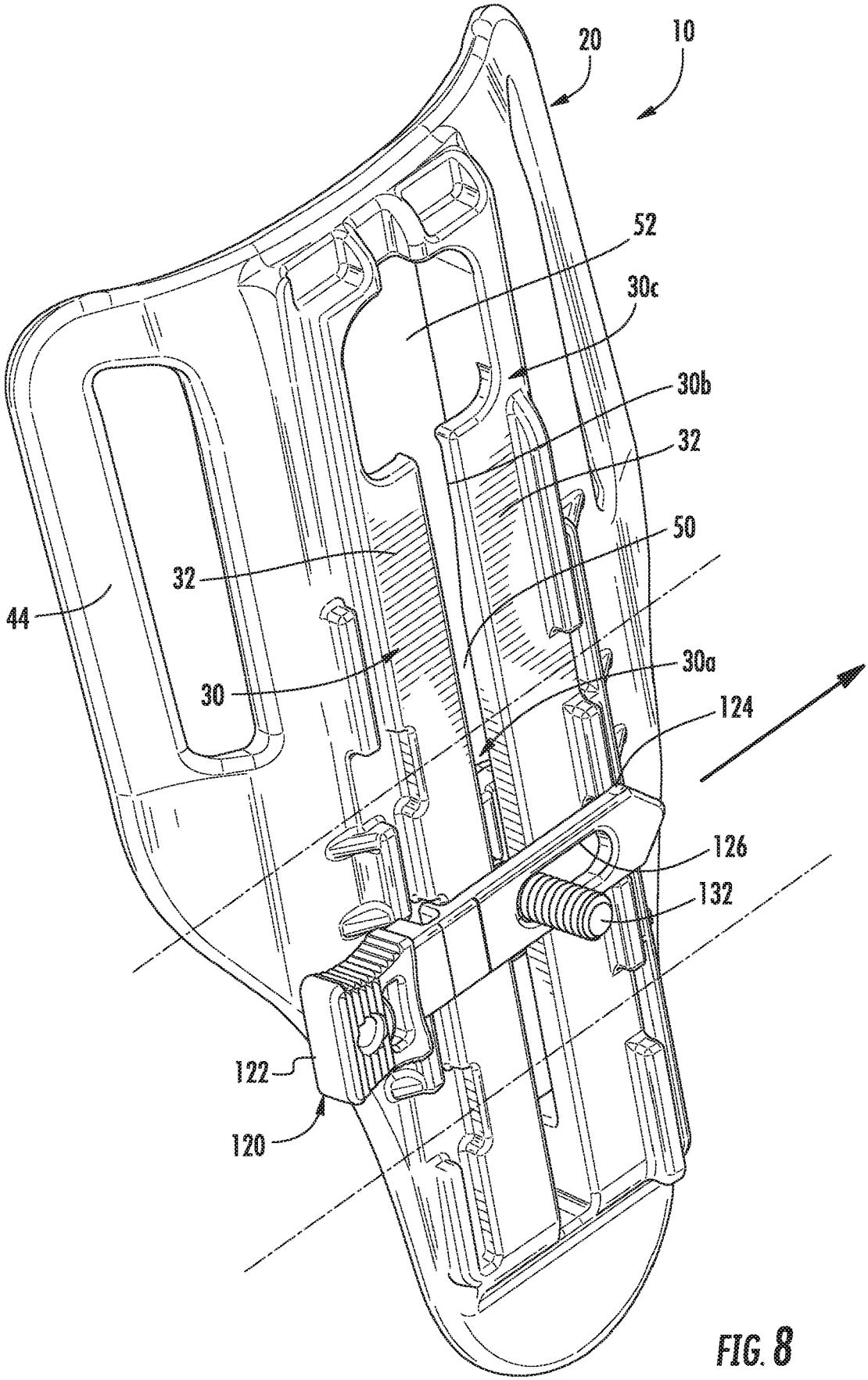
FIG. 8 is view similar to FIG. 7 illustrating the belt support with the lock bar in the closed or locked position.
Figure 9A:
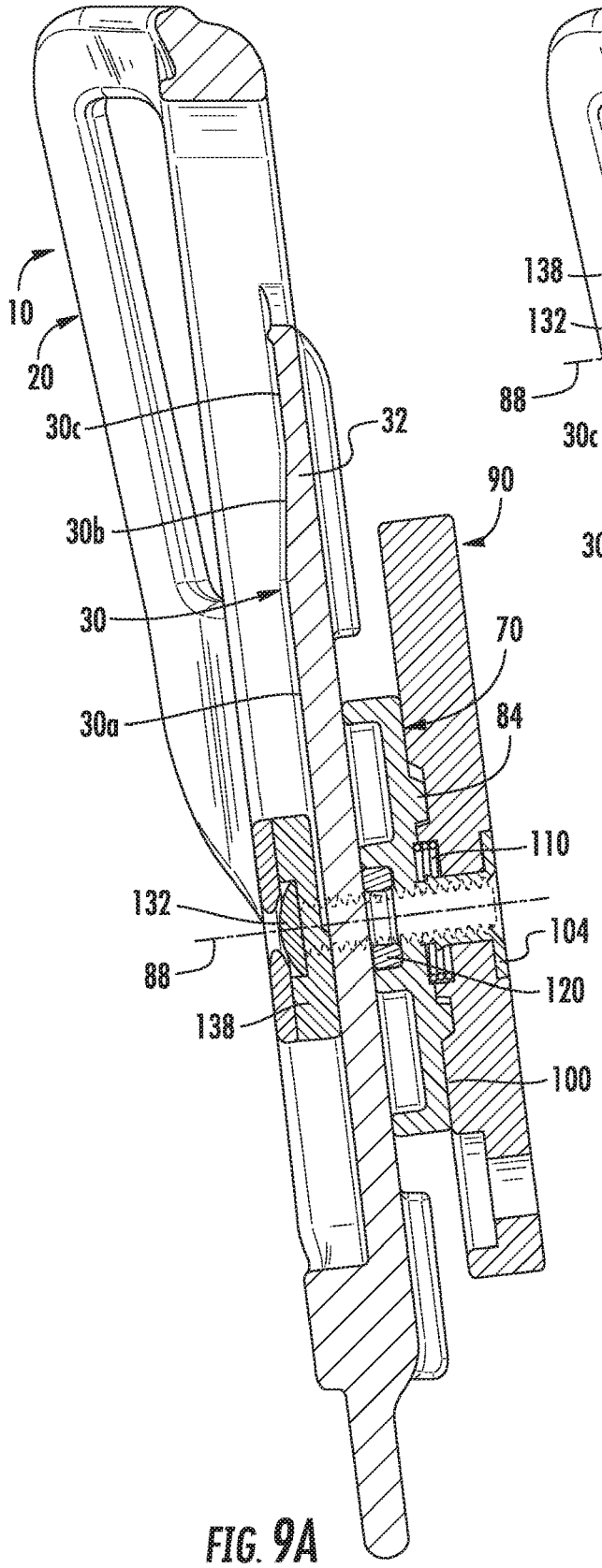
FIGS. 9A and 9B are longitudinal sectional views showing the holster assembly in a cant locked position and in a cant released position.
Figure 9B:
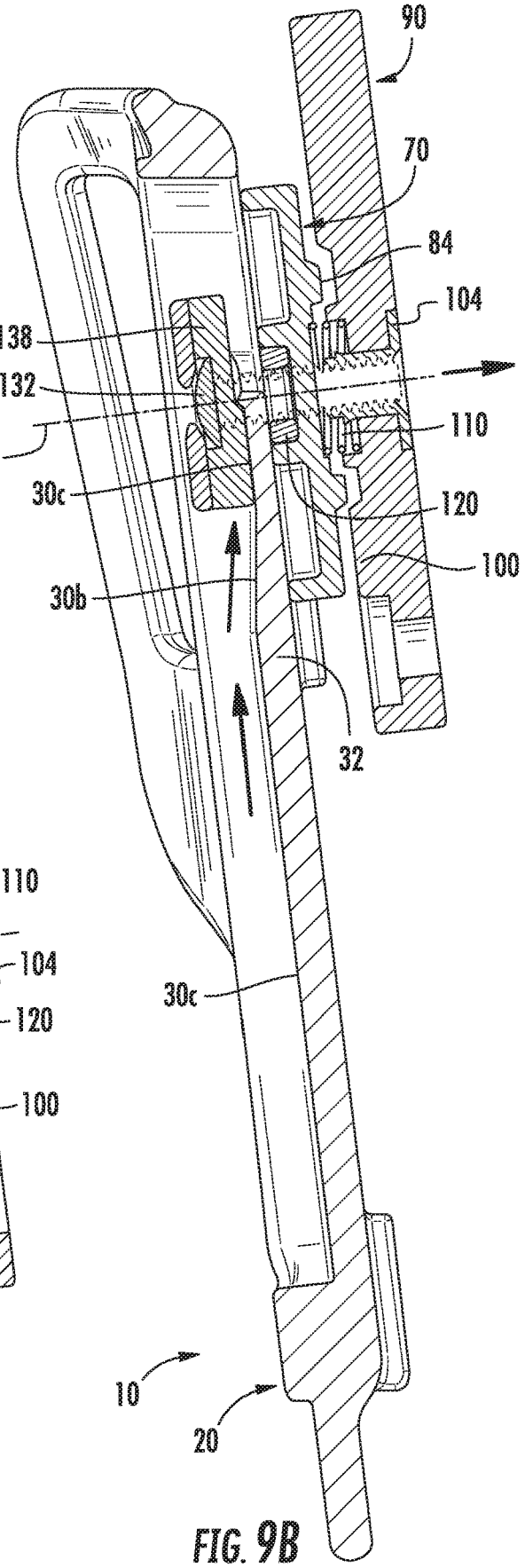

To set or change the drop height, the user withdraws the lock bar 120 to the open position shown in FIG. 7. When this is done, the slider 70 is then free to move vertically along the track 30 of the belt support 20. The user applies sufficient manual force to move the holster 12, the holster mount 90, and the slider 70 vertically, to the desired locking position 62. The lock bar 120 is then moved back to the closed position shown in FIG. 8. The lock bar 120 is securely held vertically by the detents In the belt support 20 that form the locking positions. Also, when the lock bar 120 is fully inserted (closed), the detent features 124 on the lock bar 120 engage in the notches 78 of the slider 70. This engagement resists movement of the lock bar 120 out of the closed position, ensuring that the drop height of the holster 12 is not inadvertently changed.

When the holster assembly 10 is in this way placed in any one of the three locking positions 62, the radial teeth 100 on the holster mount 90 continue to engage the radial teeth 84 on the slider 70. This engagement blocks rotation of the holster mount 90 relative to the slider 70. Because the slider 70 cannot rotate on the belt support 20, this engagement also blocks rotation of the holster mount 90 relative to the belt support 20. As a result, the cant position of the holster 12 is fixed, keeping the holster in a position for the user to quickly draw the weapon.

When the user wants to change the cant position of the holster 12, for example to sit down, the holster mount 90 needs to be rotated relative to the belt support 20 and the slider 70; consequently, the radial teeth 100 on the holster mount must be disengaged from the radial teeth 84 on the slider. To enable this disengagement to happen, the holster mount 90 and the slider 70 must be moved apart (separated) from each other in a direction along the transverse axis 88. This axial separation movement cannot occur when the holster assembly 10 is in or near any of the three locking positions 62, because the screw 130 and the nut 104 cooperate to hold the holster mount 90 in tight against the slider 70.

In order to enable this axial separation movement to occur, the slider 70 is moved upward to the release section 300 of the track 30. Specifically, the user unlocks the lock bar 120, and pulls the holster 12, holster mount 90, slider 70, and screw assembly 130 upward from the locking section 30*a* of the track 30, past the ramp section 30*b* of the track, and into the release section 30*c* of the track. This movement is seen in a comparison of FIGS. 9A and 9B.

The upward movement of the parts stops when the washer 138 engages the top of the central slot 34. Specifically, when the parts move up far enough, the two bump stops 54 on the rails 32 move into the two slots 144 on the washer 138 and limit (stop) the upward movement of the washer at that point. Thus, the shank 136 of the assembly screw 130 stays in the narrow lower section 52 of the central slot 34.

As the parts move upward in this manner, the washer 138 is sliding along the inner side surface 42 of the rails 32. The slider 70 is sliding along the outer surface 44 of the rails 32. The screw/nut combination 132/104 is a fixed length; but when the washer 138 is moved up past the ramp section 30*b* to the release section 30*c*, the rails 32 (between the screw head and the washer) are thinner, so there is some open space generated along the length of the screw shank 136, between the washer 134 and the nut 104.

This open space allows for expansion of the compression spring 110, which all along is acting between the slider 70 and the holster mount 90 to attempt to push them apart transversely. The expanding spring 110 pushes the holster mount 90 outward (to the right as viewed in FIG. 9B). The extra space and movement that is provided, by virtue of the thinner rails 32 in the release section 30*c*, is enough to allow the radial teeth 100 of the holster mount 90 to disengage from the radial teeth 84 of the slider 70. The holster mount 90 is then free to rotate relative to the slider 70. The user can change the cant position of the holster mount 90 (and the holster 12) to a more comfortable position for sitting.

When the user thereafter wants to return the holster assembly 10 to the original (standing) position, the user rotates the holster 12 and the holster mount 90 back to the original position, and then pushes the entire assembly down on the belt support 20. As this downward movement occurs, the parts move past the ramp section 30*b* of the track 30 onto the locking section 30*a* of the track. The extra space between the washer 138 and the nut 104 is taken up by the increased wall thickness of the rails 32. The holster mount 90 moves back toward the slider 70, compressing the spring 110. The radial teeth 100 of the holster mount 90 engage again with the radial teeth 84 of the slider 70, blocking relative rotational movement between those two parts. The parts can be placed in any one of the available (in this case three) locking positions 62 and can be locked there by restoring the lock bar 120 to the closed position.

A holster assembly of the present invention can be configured to be supported on a user at a location other than the user's belt. For example, a holster assembly of the present invention can be configured to be supported on, for example, a user's vest or jacket.

To this end, the parts of the holster assembly 10 of FIG. 1, other than the belt support 20, are removable from the belt support 20, to be positioned elsewhere. To effect this removal, the user unlocks the lock bar 120, allowing the slider 70 and the holster mount 90 to be moved upward on the belt support 20. The slider 70 is moved up to the release section 30*c* of the track 30, as described above.

The upward movement of the slider 70 would normally stop when the washer 138 engages the bump stops 54 as described above. With the application of sufficient force, however, the user can move the parts past the bump stops 54, pushing the holster mount 90 into slider 70 and thus compressing the spring 110, allowing sufficient room for the washer/screw assembly to travel over the bump stops 54. The washer 138 and screw head 134 then move into the enlarged upper section 52 of the central slot 34. At that point, the washer 138 and screw head 134 can be moved past the belt support 20, in a direction toward the slider 70 (to the left as viewed in FIGS. 9A and 9B), and thus be disconnected from the belt support.

Figure 10:
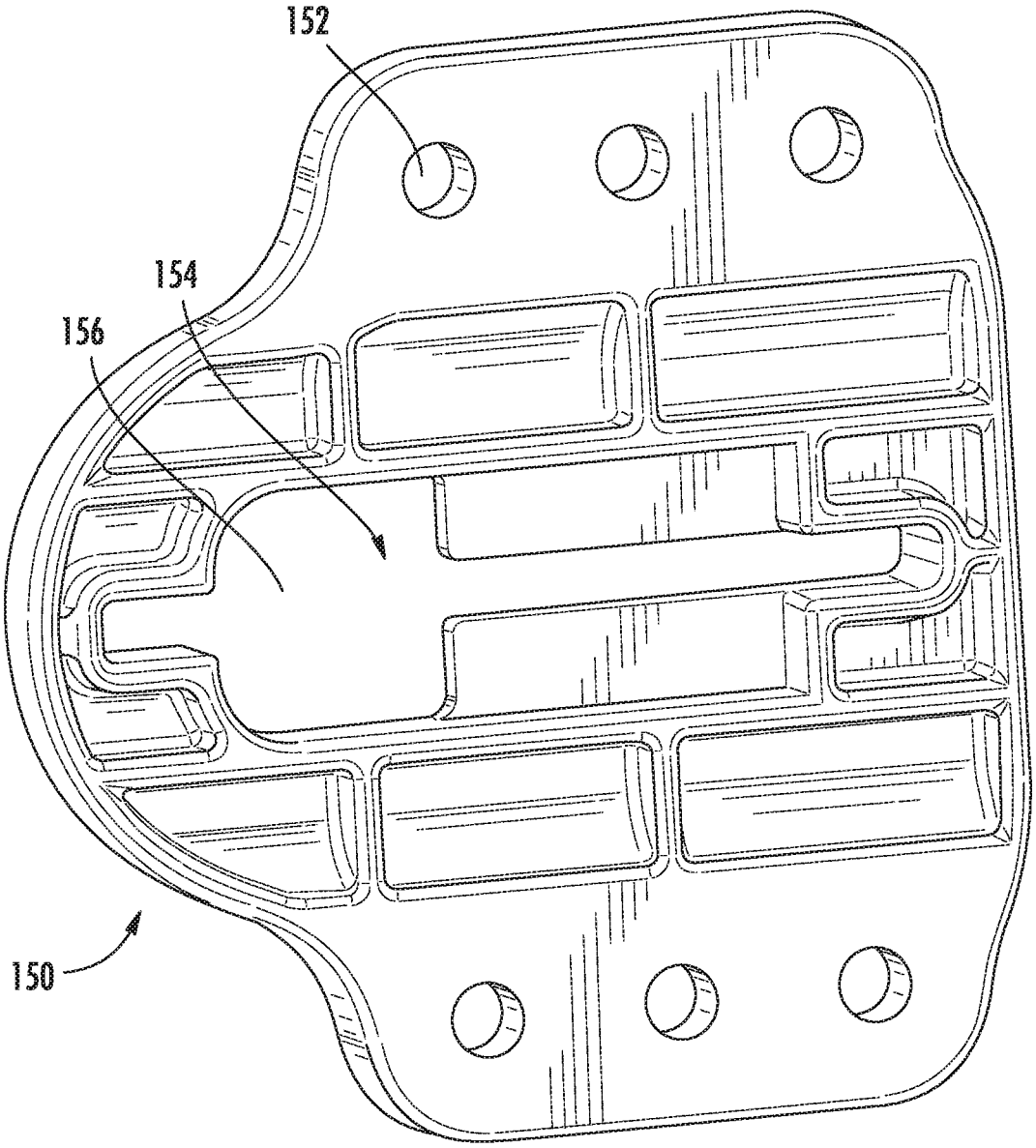
FIG. 10 is a perspective view showing an element that can be used to support a holster assembly on a user at a location other than the user's belt.

The holster 12, the holster mount 90, the slider 70, and the screw assembly 130 can then be connected with a device other than the belt support. As one example, FIG. 10 illustrates an element 150 that can be used to support those parts on, for example, a user's vest or jacket;

The element 150 has fastener openings 152 for fastening the element to the garment. The element 150 includes a central slot 154 with an enlarged end portion 156 through which the washer 138 and screw head 134 are inserted, in a direction from the opposite (not shown) side of the element. That opposite side of the element 150 includes features to engage the slider 70 and the lock bar 120, as in the assembly 10. The parts can then be moved into a locking position, sliding along the length of the central slot 154 in a direction away from the enlarged end portion 156. This particular element 150 does not include the ramp feature that enables changing the cant of the holster 12: rather, this particular element only allows the user to place the holster in a different location on the user's body or garments, or on another element such as a portion of a vehicle or structure. Other elements can have this additional feature, if desired.

In accordance with a feature of the invention, a holster assembly of the present invention may include structure that provides the user with increased control of movement of the slider along the track, specifically into the highest locking position, the spinning position, and/or the removal position. This feature is illustrated in FIGS. 11-15, which illustrate a holster assembly 10*a* that is a second embodiment of the invention. In this embodiment, parts that are the same as in the first embodiment are given the same reference numerals.

In FIGS. 11-15, the reference numeral 200 is used to designate, as a group, the three elements or pieces that slide along the track 30 of the belt mount 20, together as one unit, to effect change in drop height and to allow for adjustment of cant. These three elements, collectively denoted 200, are the holster mount 90, the slider 70, and the lock bar 120. The sliding assembly 200 can be positioned farther down the track 30 to place the holster mount 90 in one of the available locking positions. When the sliding assembly 200 and thus the slider 70 are positioned farther upward in the release section of the track 30, the slider and the holster mount 90 can be rotated, to allow for change of cant position.

In the embodiment illustrated in FIGS. 11-15, the holster assembly 10*a* includes an element that is connected with the slider 70 to enable easier positioning of the sliding assembly 200 at its several available positions along the length of the track 30 on the belt mount 20. In the illustrated embodiment, that element is a pull stick 210 that is connected for movement with the slider 70. The element could alternatively have a configuration other than the thin, elongate configuration illustrated.

Figure 15:
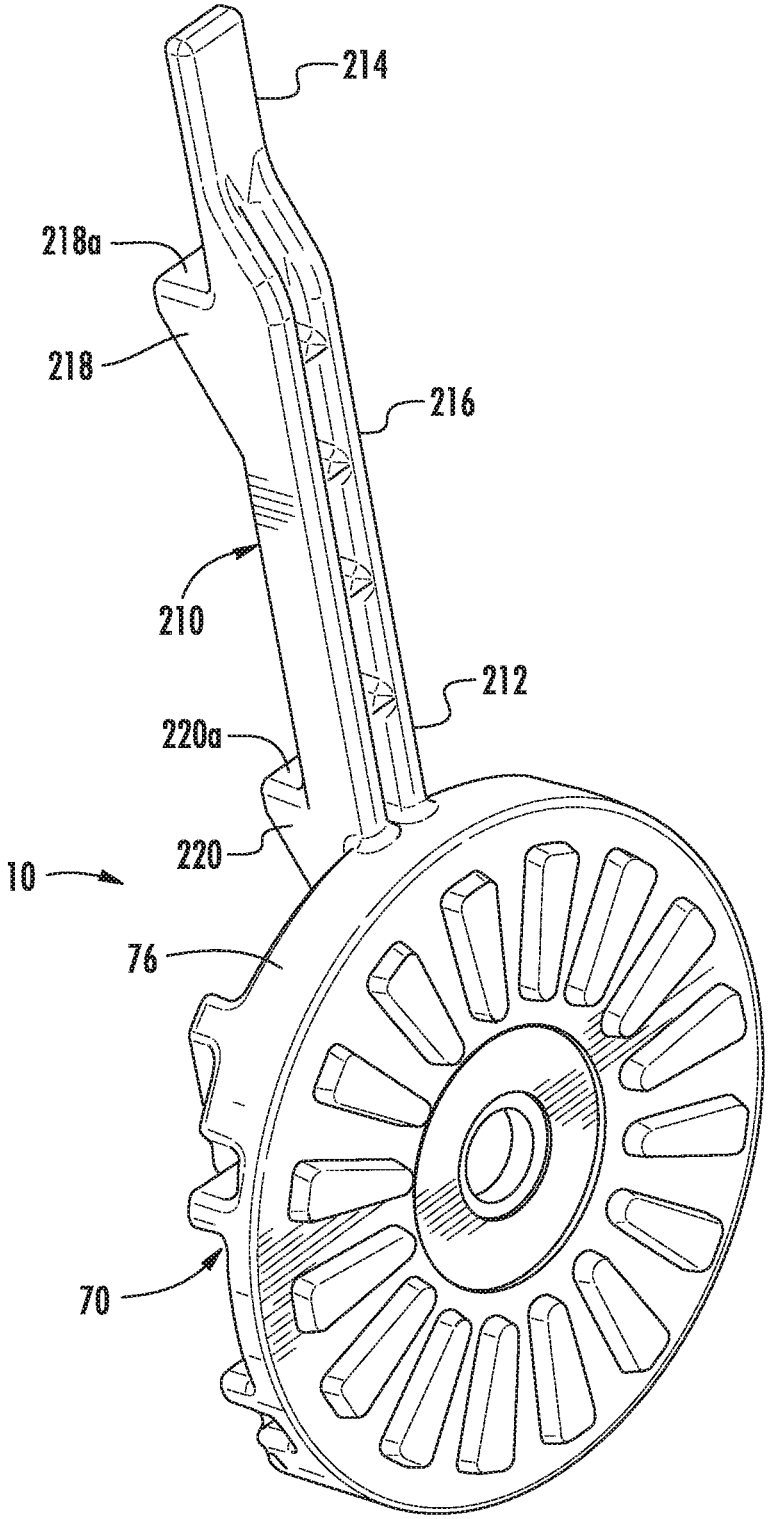
FIG. 15 is a perspective view of an element that forms part of the holster assembly of FIG. 11.

The pull stick 210 is preferably connected for movement with the slider 70 by being formed as one piece with the slider, for example by molding from plastic, as seen in FIG. 15. An inner end portion 212 of the pull stick 210 is adjacent to and extends from the outer periphery 76 of the slider 70. An opposite outer end portion 214 of the pull stick 210 is manually engageable to enable the user to grasp the pull stick and thereby manipulate the sliding assembly 200.

A longitudinally central portion 216 of the pull stick 210 supports two triangular detents or stops 218 and 220. The first and second stops 218 and 220, respectively, are spaced apart from each other along the length of the central portion 216. Specifically, the first stop 218 is located closer to the outer end portion 214 of the pull stick 210, and the second stop is located closer to the slider 70 and farther from the outer end portion. Each stop 218, 220 has a respective stop surface 218*a*, 220*a* that extends transverse to the length of the pull stick 210 and that faces in direction direction toward the outer end portion 214 of the pull stick.

When the slider 70 and the pull stick 210 are assembled in the holster assembly 10*a*, the pull stick extends outward from the slider, between the belt 20 and the holster 12, parallel to the track 30 on the belt mount 20. The outer end portion 214 of the pull stick 210 is accessible and is manually engageable by the user to enable the user to reposition the sliding assembly 200.

The belt support 20 at its upper end has a blocking surface 222 that faces toward the slider 70. The central portion 216 of the pull stick 210 extends over the track 30 of the belt support 20 and over the blocking surface 222.

Figure 11:
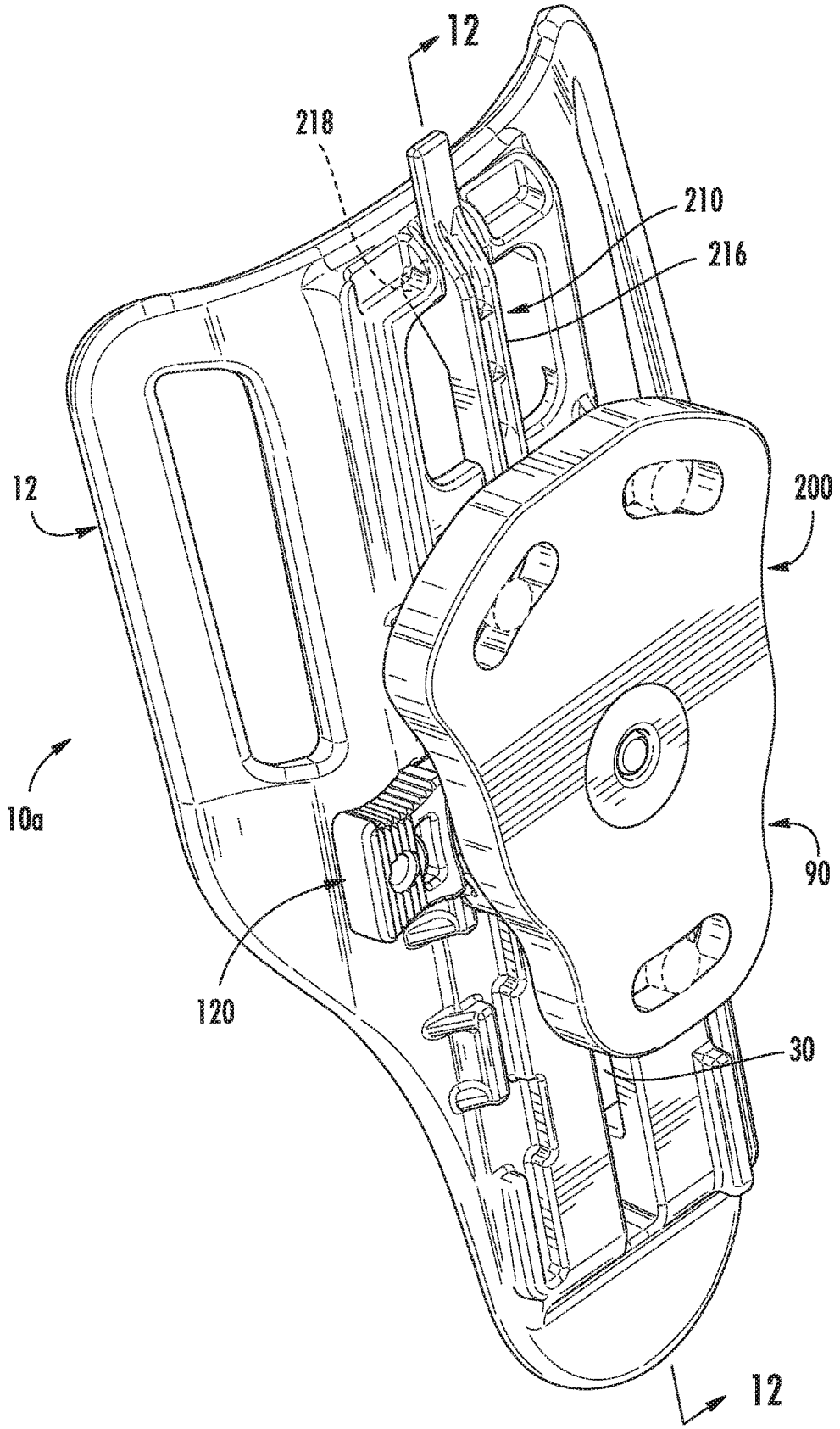
FIG. 11 is a view similar to FIG. 1 of a holster assembly that is a second embodiment of the invention, with parts of the holster assembly in a first position.
Figure 12:
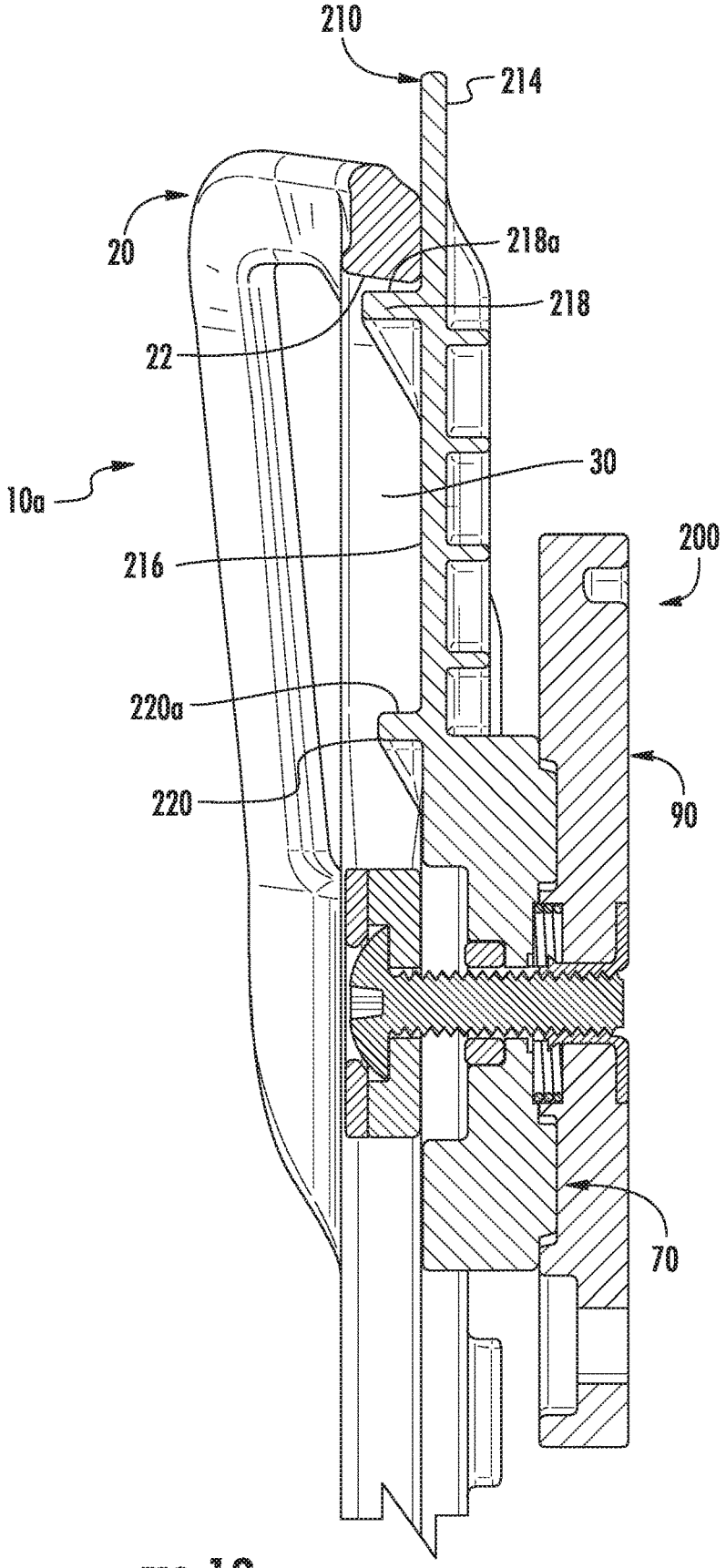
FIG. 12 is a sectional view taken generally along line 12-12 of FIG. 11.
Figure 13:
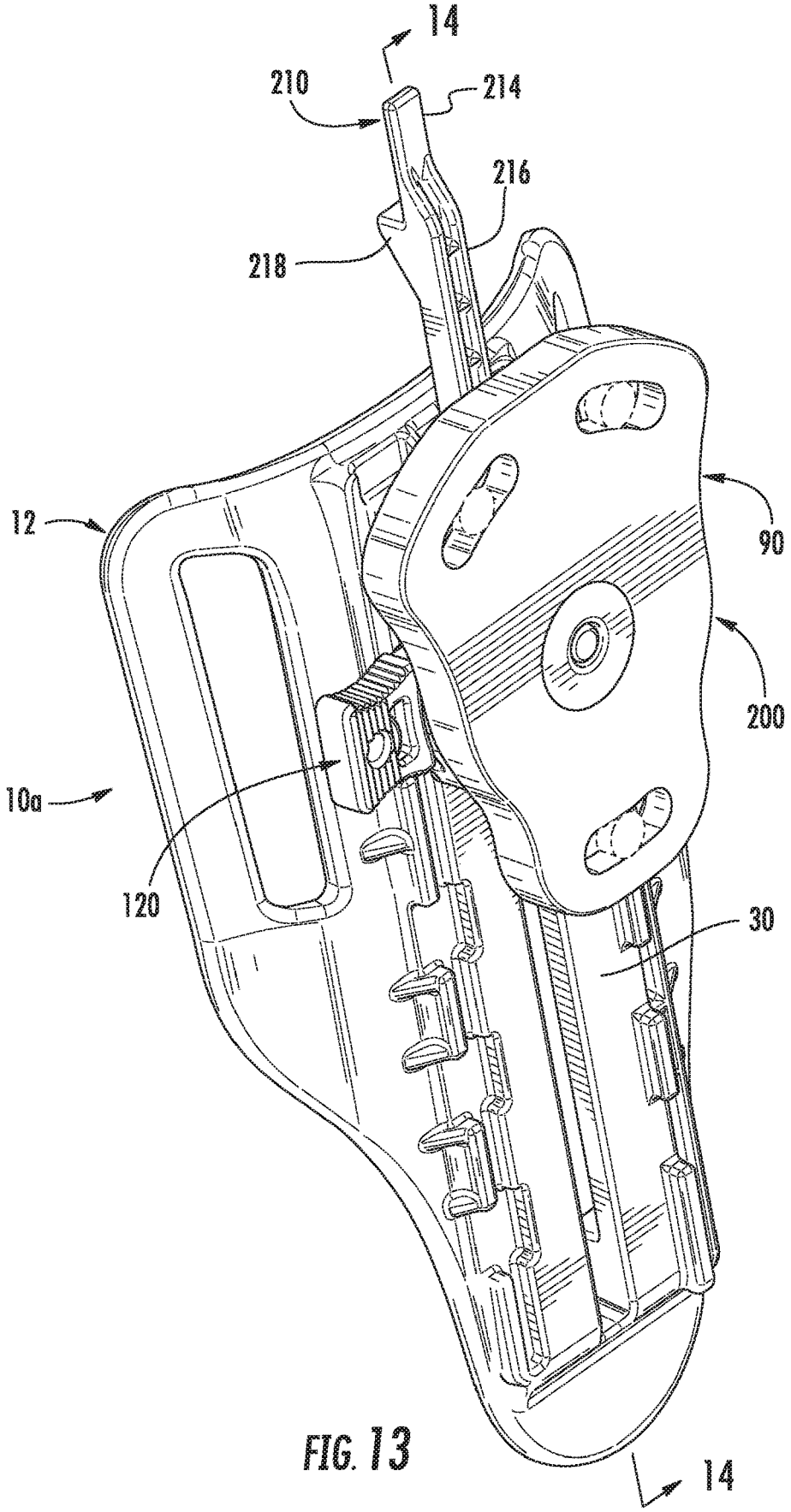
FIG. 13 is view similar to FIG. 1 of the holster assembly of FIG. 11 with parts in a second position.
Figure 14:
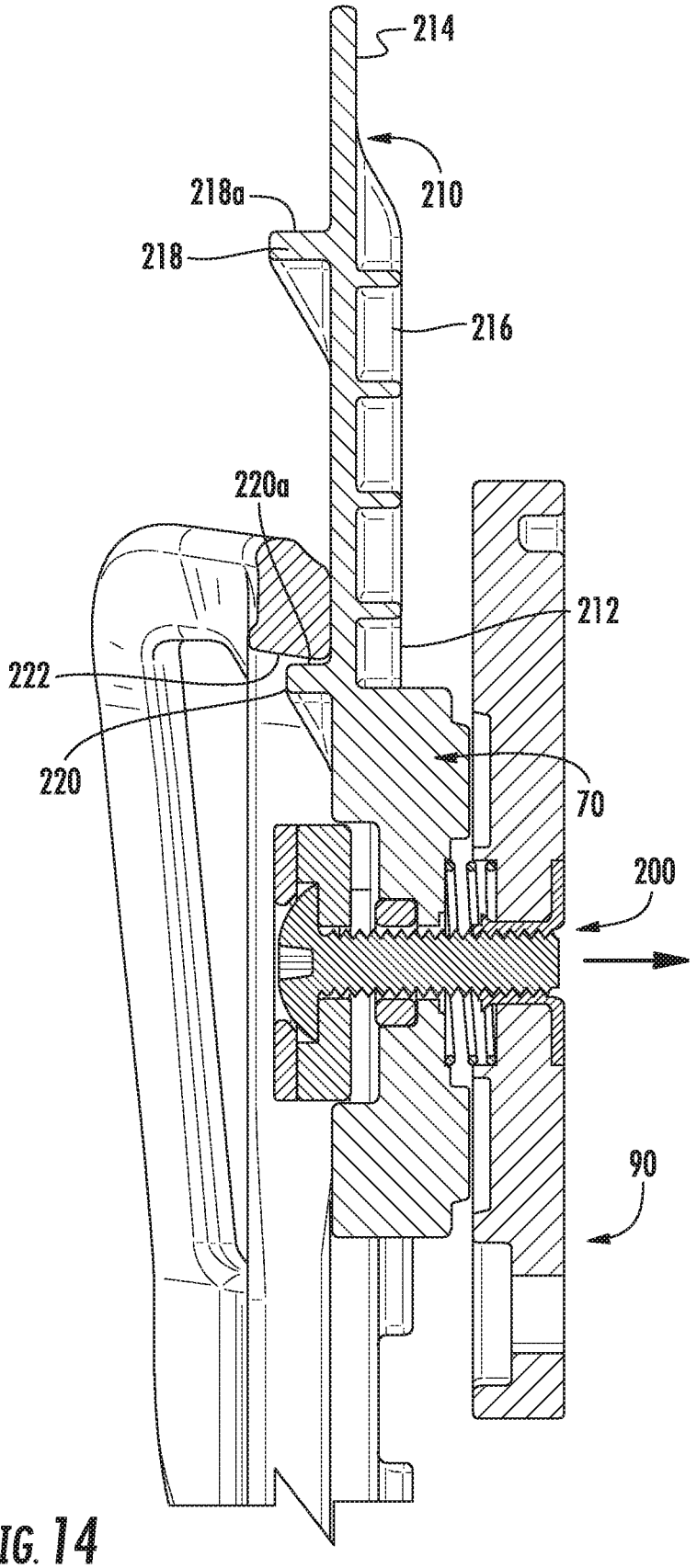
FIG. 14 is a sectional view taken generally along line 14-14 of FIG. 12.

The position of the first stop 218, along the length of the pull stick 210, is selected so that when the sliding assembly 200 is in the final (uppermost) locking position, the first stop on the pull stick is in engagement with the blocking surface 222 on the belt support 20 (FIGS. 11 and 12). As a result, the user can more directly gauge the final (uppermost) locking position, by sensing this engagement, when adjusting the height and/or cant of the holster 12.

The pull stick 210 is resiliently flexible in a direction transverse to the length of the pull stick. Specifically, the pull stick 210 can be bent or flexed in a direction so as to rove the first and second stops 218 and 220 in a direction away from the track 30 and the blocking surface 222, that is, in a direction to the right as viewed in FIG. 12. As a result, when the first stop 218 on the pull stick 210 is in engagement with the blocking surface 222 on the belt support 20, the user can grasp the outer end portion 214 of the pull stick and flex it outward, in a direction to the right as viewed in FIG. 12. The first stop 218 is displaced from the blocking surface 222 on the belt support 20, so that the pull stick 210 (and the entire sliding assembly 200) are free to be pulled upward from the final locking position to a position at which the cant of the holster 12 can be adjusted. When this "spinning" position is reached (FIGS. 13 and 14), the second stop 220 on the pull stick 210 engages the blocking surface 222 on the belt support 20 to stop the upward movement of the sliding assembly past to the spinning position. This engagement prevents the sliding assembly 200 from being moved into the release position and helps to block unintended removal of the holster from the user's belt.

If it is desired to remove the holster from the user's belt, the user can grasp the outer end portion 214 of the pull stick 210, lift the second stop 220 off the blocking surface 222, and pull farther outward until the sliding assembly 200 is in the removal position as described above. Conversely, when the sliding assembly 200 is moved from the spinning position back to one of the locking positions, the stops 218 and 220 can cam up over the blocking surface 222 of the belt support 20, if the outer end portion 214 of the pull stick 210 is not being lifted by the user.

In this second embodiment of the invention, the stop surface 220*a* stops movement of the sliding assembly 200 at the spinning position, and prevents movement of the sliding assembly past the spinning position. Therefore, the bump stops 54 on the belt support 20 and the slots 144 on the washer 138 are not needed, and may be omitted. A beneficial result of this change is that the washer 138 is then symmetrical and may be assembled in any one of its four possible orientations with respect to the other parts of the assembly 10*a*.

Figure 16:
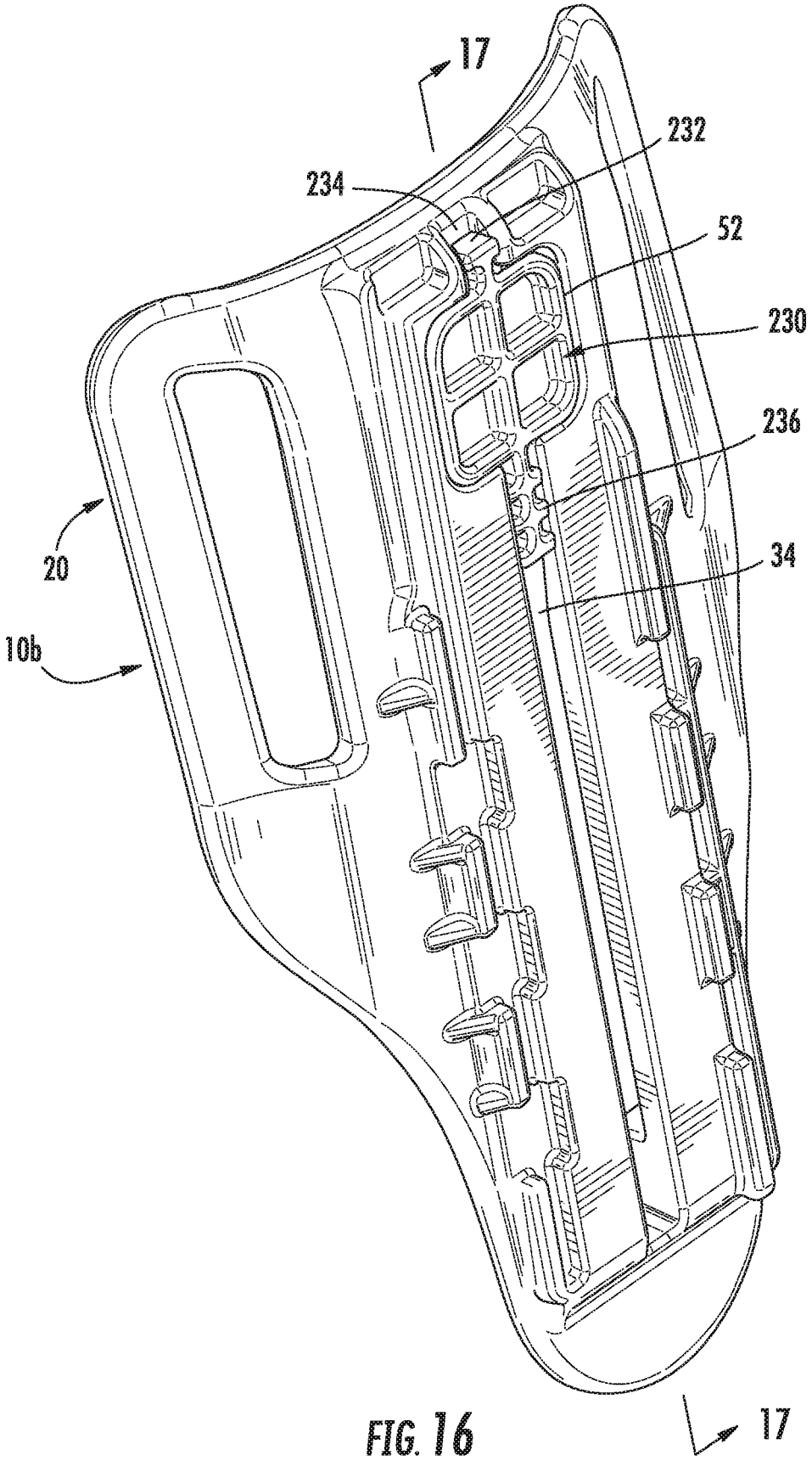
FIG. 16 is a view similar to FIG. 1 of a holster assembly that is a third embodiment of the invention.
Figure 17:
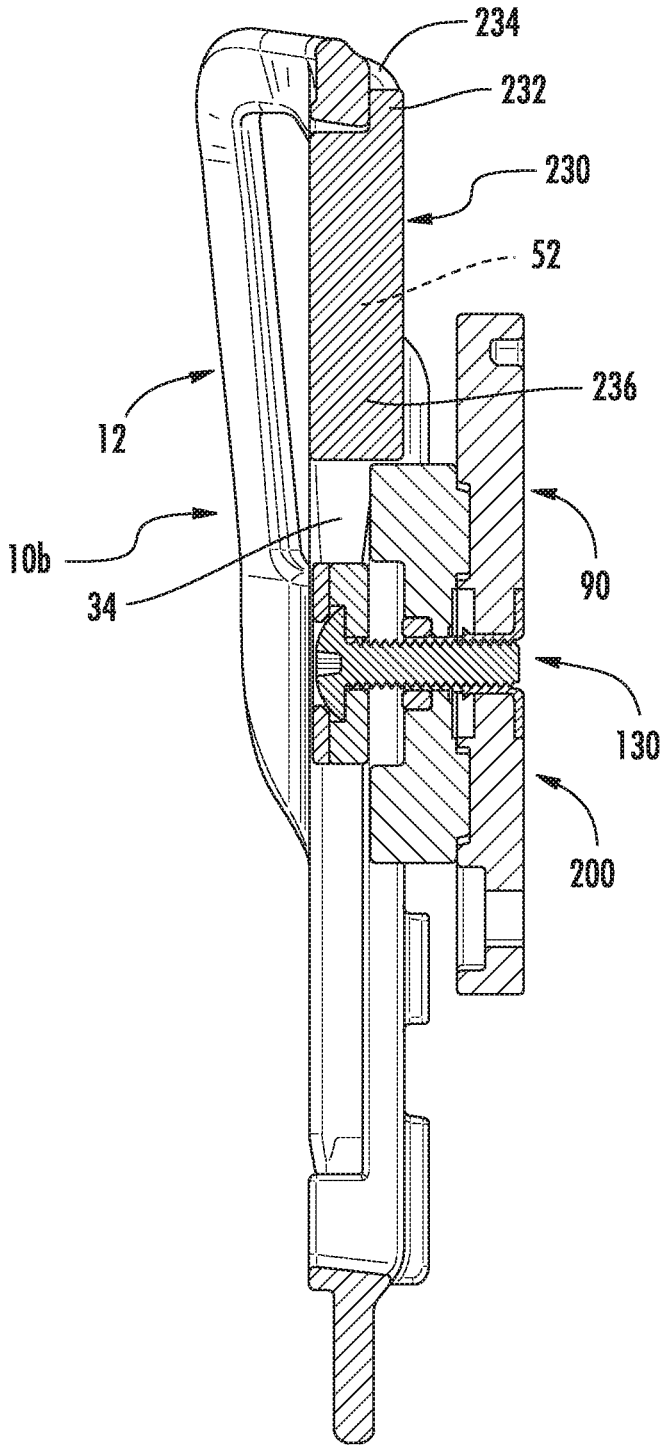
FIG. 17 is a sectional view taken generally along line 17-17 of FIG. 16.

In accordance with another feature of the invention, a holster assembly of the present invention may include structure that prevents the sliding assembly from moving past the spinning position into the removal position. This feature is illustrated in FIGS. 16 and 17, which illustrate a holster assembly 10*b* that is a third embodiment of the invention. In this embodiment, parts that are the same as in the first embodiment are given the same reference numerals.

Specifically, the holster assembly of FIGS. 16 and 17 includes, in addition to the elements described above with reference to the first embodiment, a blocking member or insert 230. The insert 230 is a separate element or part that is configured to releasably fit into the enlarged upper section 52 of the central slot 34 in the belt support 20. Thus, in this embodiment, the insert 230 has a main body portion 231 with a generally square configuration.

When in place in the belt support 20, the insert 230 is securely retained in the belt support 20. A pin 232 on the upper edge of the main body portion 211 of the insert 230 fits into a slot 234 on the upper edge of the belt support 20. A slot portion or tail portion 236 of the insert 230, on the lower edge of the main body portion 211 of the insert, fits into the upper end of the main portion 50 of the central slot 34.

The dimensions of the insert 230 as compared to the belt support 20 are selected to provide the insert 230 with an interference fit in the belt support. Thus, the insert 230 can only be intentionally, and not inadvertently, placed into or removed from engagement with the belt support 20.

When the insert 230 is located in the opening 52, the tail portion 236 of the insert 230 blocks off the upper end of the central opening 34 in the belt support 20. Thus, the screw assembly 130 cannot move into the opening 52, to the spinning position. This feature prevents cant adjustment of the holster 12. Additionally, the sliding assembly 200 cannot be moved far enough up the track 30 to enable the holster 12 to be removed from the belt support 20. This feature prevents inadvertent (or intentional) removal of the sliding assembly 200, and the holster 12, from the belt mount 20.

In this third embodiment of the invention, the insert 230 prevents movement of the sliding assembly 200 into the spinning position. Therefore, the bump stops 54 on the belt support 20 and the slots 144 on the washer 138 are not needed, and may be omitted. A beneficial result of this change is that the washer 138 is then symmetrical and may be assembled in any one of its four possible orientations with respect to the other parts of the assembly 10*a*.

The invention claimed is:

1. A holster support assembly for use by a user wearing a belt, including:

a belt support that engages and is supported by the user's belt;

a holster mount supported on the belt support for sliding movement relative to the belt support, the holster mount configured for supporting a holster;

the belt support having a track and defining a plurality of drop positions spaced apart along the track in which the holster mount can be located to enable the user to set the drop height of the holster, the holster mount being blocked from rotation relative to the belt support when the holster mount is in any of the drop positions;

the belt support also defining a spinning position of the belt support the holster mount being rotatable relative to the belt support to adjust the cant position of the holster when the holster mount is in the spinning position; and a pull stick that is connected for movement with the holster mount and that has a manually engageable portion for grasping by the user to manipulate the position of the holster mount along the belt support;

the pull stick having a first stop engageable with a stop surface on the belt support for stopping movement of the holster mount at a specified drop position.

2. A holster support assembly as set forth in claim 1 wherein the pull stick is resiliently flexible to enable movement of the first stop past the stop surface.

3. A holster support assembly as set forth in claim 2 wherein the pull stick has a second stop, spaced apart from the first stop, engageable with the stop surface on the belt support for stopping movement of the holster mount at the spinning position.

4. A holster support assembly as set forth in claim 3 wherein the pull stick is resiliently flexible to enable movement of the second stop past the stop surface.

5. A holster support assembly as set forth in claim 1 wherein the holster mount is supported on a slider and is movable along the belt support with the slider between the plurality of drop positions, the holster mount being selectively engageable with and disengageable from the slider, the holster mount being rotatable relative to the slider about an, axis when disengaged from the slider to enable the user to set the cant position of the holster relative to the belt support, and the pull stick being formed as one piece with the slider.

6. An assembly as set forth in claim 1 wherein:

the track has a lower section, including the drop positions, and the holster mount cannot be disengaged from the slider when the slider is on the lower section of the track; and the track has an upper section, including the spinning position, at which the holster mount is disengageable from the slider to enable the user to adjust the cant position of the holster relative to the belt support.

7. An assembly as set forth in claim 6 wherein the track includes walls on the belt support that have a varying wall thickness, the walls being thinner in the upper section of the track and thicker in the lower section of the track, and the holster mount being disengageable from and movable away from the slider to enable cant adjustment when the slider is in the upper section of the track having the thinner wall sections.

8. A holster support assembly as set forth in, claim 7 including a fixed length screw/nut assembly that slides along the track, and wherein the space between the screw head and the nut opens up when the screw/nut assembly is in the thinner wall thickness section of the track, enabling a spring to push the holster mount away from the belt support to enable rotation of the holster mount relative to the belt support.

9. An assembly as set forth claim 7 wherein the holster mount is movable away from the slider and the track to enable rotation of the holster mount relative to the slider.

10. A holster support assembly for use by a user wearing a belt, including:

a belt support that engages and is supported by the users belt;

a holster mount supported on the belt support for sliding movement relative to the belt support, the holster mount configured for supporting a holster;

the belt support having a track and defining a plurality of drop positions spaced apart along the track in which the holster mount can be located, to enable the user to set the drop height of the holster, the holster mount being blocked from rotation relative to the belt support when the holster mount is in any of the drop positions;

the belt support also defining a spinning position of the belt support, the holster mount being rotatable relative to the belt support to adjust the cant position of the holster when the holster mount is in the spinning position; and a blocking insert that is releasably positioned on the belt support and that prevents movement of the holster mount into the spinning position.

11. A holster support assembly as set forth in claim 10 wherein the belt support includes track wall portions defining the track along which the holster mount slides, the track wall portions having a slot between them the track wall portions including:

first track wall portions along which the holster mount slides when moving between the plurality of drop positions, the first track wall portions having a first thickness;

second track well portions at the location of the spinning position, the second track well portions having a second wall thickness that is less than the first wall thickness to enable the holster mount to spin relative to the belt support when at the spinning position; and the blocking insert having a slot portion releasably positioned at the location of the second wall portions, to block movement of the holster mount into the spinning position and thereby block rotational movement of the holster mount relative to the belt support.

12. A holster support assembly as set forth in claim 11 wherein the slot portion of the blocking insert is releasably positioned in a narrow portion of the slot, the track wall portions including third track well portions that define a widened portion of the slot, the blocking insert having a main body portion that is releasably positioned in the widened portion of the slot, the holster mount being removable from the belt support when a mounting screw assembly of the holster mount is located at the widened portion of the slot.

13. A holster support assembly for use by a user wearing a belt, including:

a belt support that engages and is supported by the users belt;

a holster mount supported on the belt support for sliding movement relative to the belt support, the holster mount configured for supporting a holster;

the belt support having a track and defining a plurality of drop positions spaced apart along the track in which the holster mount can be located to enable the user to set the drop height of the holster, the holster mount being blocked from rotation relative to the belt support when the holster mount is in any of the drop positions;

the belt support also defining a spinning position of the belt support, the holster mount being rotatable relative to the belt support to adjust the cant position of the holster when the holster mount is in the spinning position; and an element that is connected for movement with the holster mount to enable easier positioning of the holster mount at the drop positions and the spinning position, the element having a manually engageable portion for grasping by the user to manipulate the position of the holster mount along the belt support, the element having a first stop engageable with a stop surface on the belt support for stopping movement of the holster mount at a specified drop position.

14. A holster support assembly as set forth in claim 13 wherein the element is a pull stick.

15. A holster support assembly as set forth in claim 13 wherein the element is formed as one piece with a slider that forms part of the holster support assembly, an inner end portion of the element is adjacent to and extends from the outer periphery of the slider, and an opposite outer end portion of the element is manually engageable to enable the user to grasp the element and thereby manipulate the slider and the holster mount.

* * * * *